US005402729A

United States Patent [19]

Richert

[11] Patent Number: 5,402,729

[45] Date of Patent: Apr. 4, 1995

[54] MUNITION FOR LOW-PRESSURE FIRING OF PROJECTILES FROM LARGE-CALIBER GUNS

[76] Inventor: Pierre Richert, 18 rue du General Gouraud 57158, Montigny Les Metz, France

[21] Appl. No.: 182,085

[22] PCT Filed: May 13, 1993

[86] PCT No.: PCT/FR93/00466

§ 371 Date: Apr. 14, 1994

§ 102(e) Date: Apr. 14, 1994

[87] PCT Pub. No.: WO93/23717

PCT Pub. Date: Nov. 25, 1993

[30] Foreign Application Priority Data

May 15, 1992 [FR] France ..... 92 06092

[51] Int. Cl.[6] ..... F42B 5/02

[52] U.S. Cl. ..... 102/439; 102/334; 102/367; 102/430; 102/447; 102/470; 102/502; 102/529

[58] Field of Search ..... 102/334, 367, 368, 370, 102/430, 439, 444, 446, 447, 469, 470, 490, 501, 502, 529; 244/3.1

[56] References Cited

U.S. PATENT DOCUMENTS

| | | | |
|---|---|---|---|
| H114 | 8/1886 | Quintavalle | 102/513 |
| 1,819,090 | 8/1931 | Goss | 102/367 |
| 3,157,126 | 11/1964 | Blondeau | 102/501 |
| 3,707,918 | 1/1973 | Dunfee et al. | 102/334 |
| 3,713,383 | 1/1973 | Crescenzo et al. | 102/368 |
| 3,771,451 | 11/1973 | Woodring | 102/439 |
| 3,983,817 | 10/1976 | Tucker | 102/41 |
| 4,938,146 | 7/1990 | Gunther et al. | 102/439 |
| 5,035,138 | 7/1991 | Luxton | 102/502 |

FOREIGN PATENT DOCUMENTS

| | | |
|---|---|---|
| 789881 | 10/1973 | Belgium . |
| 0337903 | 10/1989 | France . |
| 9110877 | 7/1991 | WIPO . |
| 9114148 | 9/1991 | WIPO . |

*Primary Examiner*—Harold J. Tudor

*Attorney, Agent, or Firm*—Eckert Seamans Cherin & Mellott

[57] ABSTRACT

Ammunition comprising a cylindrical case (1) with one of the closed ends having coaxially a concentric chamber (1*a*) capable of receiving a propulsive means for a projectile lodged in the case. The propulsive means consists of a blank cartridge (2) lodged in a diffusing means (3), the cartridge and diffusing means assembly being inserted into the coaxial chamber of the case.

8 Claims, 4 Drawing Sheets

MUNITION FOR LOW-PRESSURE FIRING OF PROJECTILES FROM LARGE-CALIBER GUNS

The invention relates to the field of munitions engineering.

Munitions for large-caliber firearms are known which are designed to fire various projectiles, these are generally made to avoid penetration on impact with the human target and are therefore non-lethal munitions.

The projectiles used are fragile and it is therefore not possible to use propulsion systems that necessitate high-pressure pyrotechnics. Such projectiles must therefore be fired at low pressure.

To achieve this, it is possible to use gunpowder which has a fast, complete combustion range at a relatively low pressure. However, gunpowder creates smoke and significant residues.

In an attempt to overcome these drawbacks, a munition has been proposed comprising a cylindrical shell in one end of which a projectile is fitted whereas the other end has a concentric chamber accommodating a small sized cartridge. The chamber has a constant, uniform inside diameter over its entire length which matches that of the cartridge in order to prevent any high pressure being reached. The cartridge is filled with pyroxylin powder and has a detonator made of a fulminate compound.

This state of the art is described in patent FR2630603.

This solution has very considerable advantages but is not entirely satisfactory. In fact, the explosive does not burn completely and does not always provide an adequate increase in pressure.

The purpose of the invention is to overcome these disadvantages in a simple, reliable, effective and rational way.

The problem that the invention intends to solve is to obtain an increase in pressure in order to impart velocity to the projectile without thereby damaging it. In particular, the problem that the invention intends to solve is to increase the pressure in the cartridge rather than in the chamber that accommodates the projectile.

In order to solve such a problem, a munition was designed and developed comprising a cylindrical shell of which one closed end has a coaxially concentric chamber suitable to accommodate a means of propelling a projectile fitted in said shell, the means of propulsion consisting of a "blank" cartridge housed in a diffusing device with the cartridge and diffuser device assembly being inserted into the coaxial chamber of the shell.

The diffusing device has a coaxial chamber in which the cartridge is inserted.

In order to solve the problem of preventing any increase in pressure in the chamber, the chamber of the diffusing device communicates with oversized lateral openings around the periphery of which the sum of the cross-sectional areas exceeds the nominal cross-sectional area of said chamber.

Using this basic design, the munition can fire any type of projectile made from a solid body made of flexible material or comprising flexible envelopes containing a liquid.

Nevertheless, preferably and according to another feature of the invention, the projectile consists of a cylindrical body enclosing an internal space suitable for containing means of "crowd dispersal" capable of being released under the effect of destruction of said body in combination with a detonator controlled by a delay element.

The detonator is mounted in a cylindrical recess formed coaxially at one of the ends of the body so that it can be ignited by the gases from the cartridge/diffuser assembly.

In order to solve the problem of maintaining the means of crowd dispersal inside the body, the end of the body opposite to that which accommodates the detonator is sealed by a cover.

In order to solve the problem of limiting the drift of the trajectory of the projectile due to the effect of the thrust of air, the cover has concentric grooves and a central non-opening recess.

In order to solve the problem of encouraging bursting of the body, the latter has grooves formed along the generating lines of the body.

Advantageously, the means of crowd dispersal consist of CS powder, iron shot or liquid.

The invention is explained below in more detail, reference being made to the accompanying drawings in which.

Figure 1A:
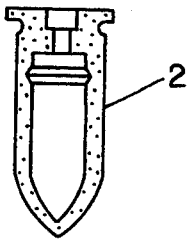
FIGS. 1A, 1B and 1C are cross-sectional view showing, before assembly, the main components of the cartridge.
Figure 1B:
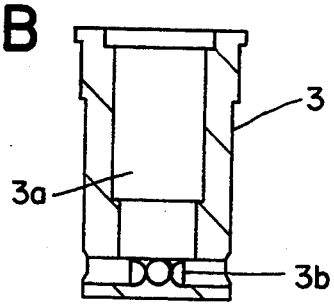
Figure 1C:
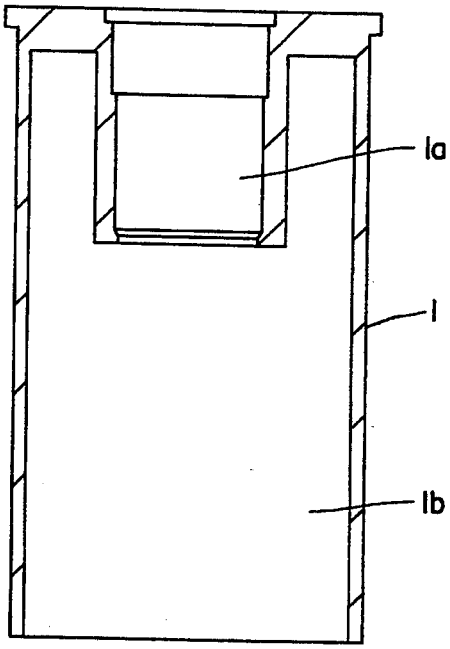
Figure 2:
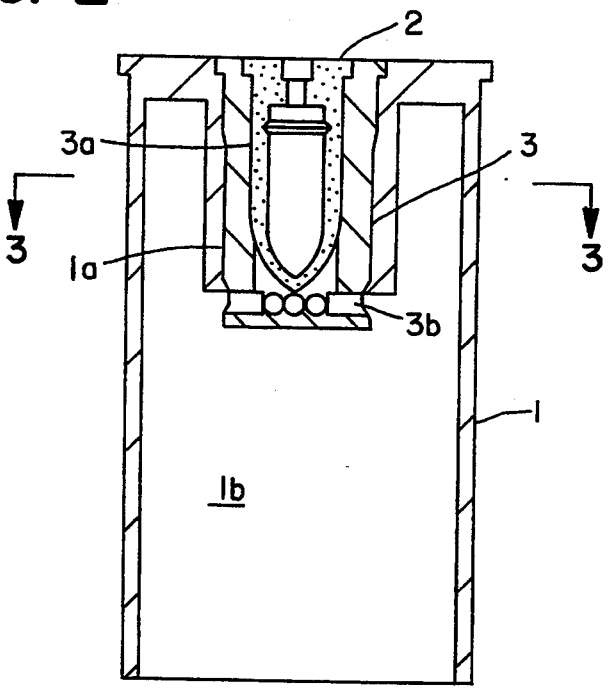
FIG. 2 is a view equivalent to FIG. 1 after assembly of the various components.
Figure 3:
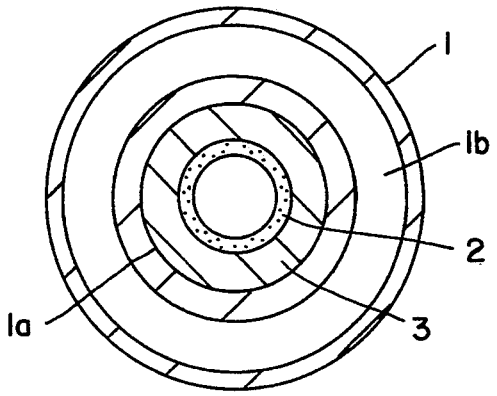
FIG. 3 is a transverse cross-sectional view along line 3.3 in FIG. 2.
Figure 4:
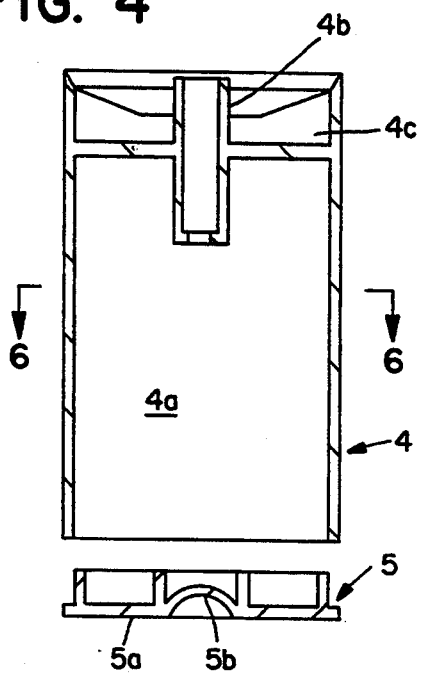
FIG. 4 is a longitudinal cross-sectional view before assembly of the main components of the projectile.

As shown in FIG. 1, the munition comprises a cylindrical shell (1) made of a flexible plastic material which, in particular, is not brittle at low temperature. One of the ends of the shell (1) is closed and has a coaxial concentric chamber (**1*a*) suitable for accommodating a means of propelling a projectile (P). The projectile (P) is fitted in shell (1) after being inserted through opening (1*b*). Chamber (1*a***) has a uniform, constant diameter over its entire length.

According to the invention, the means of propulsion comprises a blank cartridge (2) placed in a diffusing device (3). The cartridge (2)/diffuser (3) assembly is inserted in coaxial chamber (**1*a*) of the shell. The diffusing device (3) has an internal chamber (3*a*) in which blank cartridge (2) of a known, appropriate type is inserted. Internal chamber (3*a*) communicates with lateral openings (3*b*) arranged around the periphery at the end of diffusing device (3**) opposite its open end for insertion of the cartridge.

Importantly, these openings (**3*b*) are oversized so that the sum of their cross-sectional areas exceeds the nominal cross-sectional area of internal chamber (3*a***).

These precautions prevent any increase in pressure in chamber (3*a*) and only allow an increase in pressure in cartridge (2).

Figure 5A:
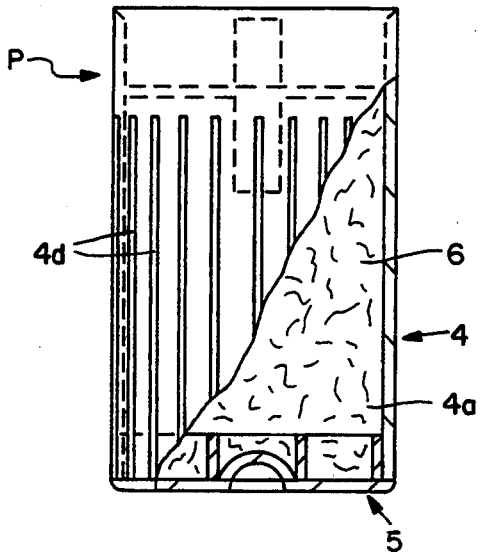
FIG. 5A is a view equivalent to FIG. 4 after assembly of the main elements of the projectile.
Figure 5B:
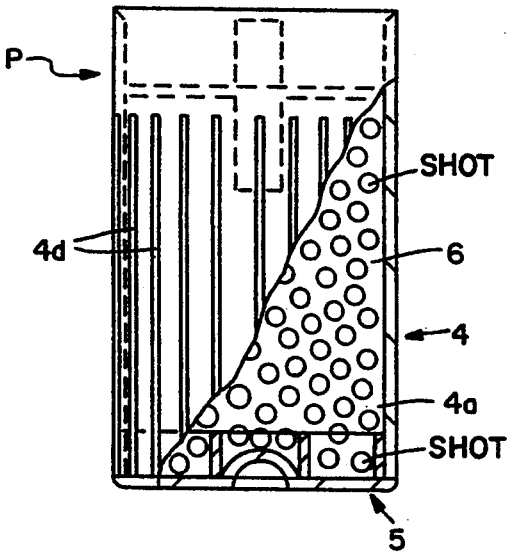
FIG. 5B is a view equivalent to FIG. 4 after assembly of the main elements of the projectile showing iron shot in the enclosed internal space.
Figure 5C:
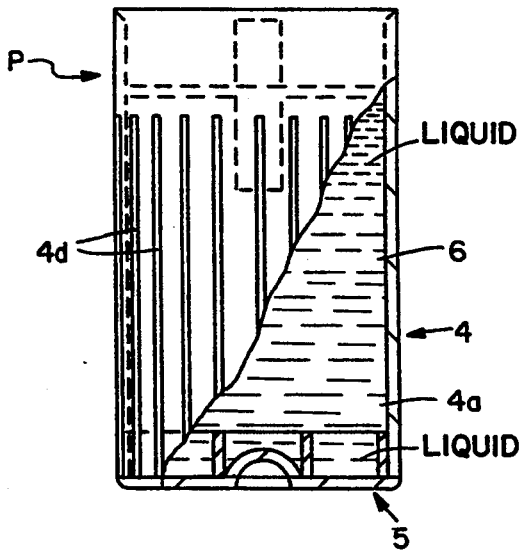
FIG. 5C is a view equivalent to FIG. 4 after assembly of the main elements of the projectile showing-liquid in the enclosed internal space.
Figure 6:
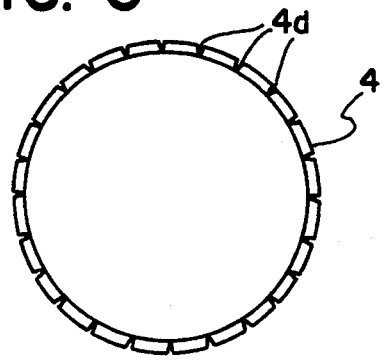
FIG. 6 is a transverse cross-sectional view along line 6.6 in FIG. 5A.
Figure 7:
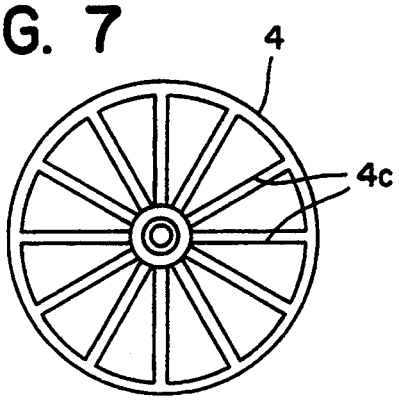
FIG. 7 is a plan view equivalent to FIG. 5A.
Figure 8:
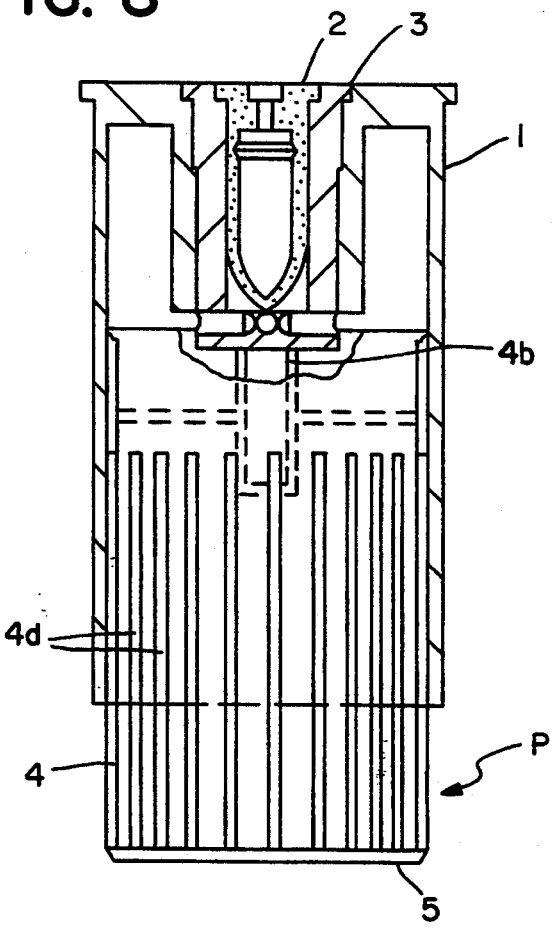
FIG. 8 is a view showing the projectile in the munition.

According to another characteristic, projectile (P) consists of a cylindrical body (4) enclosing an internal space (4*a*) suitable for containing means of crowd dispersal (6) such as CS powder (FIG. 5A), shot (FIG. 5B), liquid (FIG. 5C) etc.

A detonator controlled by a delay element is mounted in a cylindrical recess (4*b*) formed coaxially at one of the ends of body (4). After inserting body (4) in shell (1), the detonator/delay element assembly is coaxially aligned with the cartridge (2)/diffuser (3) assembly so that it can be ignited by the gases from said cartridge. Cylindrical recess (4*b*) is formed coaxially on bottom (4*c*) offset from the corresponding end of cylindrical body (4). At the opposite end, the open end of body (4) is closed by a cover (5). This cover has concentric grooves (5*a*) and a central non-opening recess (5*b*). Body (4) has longitudinal grooves (4*d*) formed along generating lines and devised to provide lines of preferential fracture in order to encourage bursting of the body under the effects of the action of the detonator.

Body (4) is inserted manually through the open end (1*b*) of shell (1) and is secured there by moderate clamping.

The munition and the projectile as defined and illustrated are suitable for any type of large-calibre firearm used, particularly, as a non-lethal defence weapon.

The advantages are apparent from the description, the following aspects are particularly emphasised and restated:

the blank cartridge in combination with the diffuser makes it possible to increase the pressure and, consequently, to increase the velocity of the projectile without damaging it, there is no increase in pressure in the chamber, as the gases are diffused through the openings.

I claim:

1. Ammunition for low-pressure launching of projectiles capable of being fired from large-caliber guns, comprising:

a cylindrical case having a closed end, said closed end including a coaxial, concentric chamber; a projectile located in an end of said cylindrical case opposite said closed end;

a diffuser device having a coaxial chamber of a nominal diameter and a nominal cross-sectional area;

a blank cartridge propulsion means housed in said coaxial chamber of said diffuser device for propelling the projectile, to define a propulsion means-diffuser device combination, said propulsion means-diffuser device combination being housed in said coaxial, concentric chamber of said cylindrical case, wherein said coaxial chamber of said diffuser device is coupled to lateral orifices peripherally arranged on said diffuser device, said orifices each having diameters and cross sectional areas, the combined cross-sectional areas of the orifices being larger than the nominal cross-sectional area of said coaxial chamber of said diffuser device, so as to diffuse pressure build-up via said orifices upon firing to within said blank cartridge propulsion means and thereby prevent pressure build-up within said diffuser device chamber.

2. The ammunition of claim 1, wherein said projectile has a substantially hollow, cylindrical body having two ends, and an internal volume for receiving dispersing means which are released upon destruction of said body caused by retarded detonation of said body by a detonator.

3. The ammunition of claim 2, wherein said detonator is mounted in a cylindrical housing disposed coaxially at one of said ends of said body, whereby said detonator is ignited by gases from the propulsion means-diffuser device combination.

4. The ammunition of claim 3, further comprising a cap blocking the end of said body opposite said detonator.

5. The ammunition of claim 4, wherein said cap has concentric grooves and a blind central recess.

6. The ammunition of claim 2, wherein said body has means facilitating discharge upon detonation.

7. The ammunition of claim 6, wherein said means is defined by grooves formed on said body.

8. The ammunition of claim 2, wherein said dispensing means comprises of one of CS powder, iron shot and liquid.

* * * * *